US005467918A

United States Patent [19]

Glover

[11] Patent Number: 5,467,918

[45] Date of Patent: Nov. 21, 1995

[54] CONTROLLED ACCESS COLLECTION CONTAINER

[76] Inventor: Michael W. Glover, 203 County Rd. ·1094, Cullman, Ala. 35055

[21] Appl. No.: 209,259

[22] Filed: Mar. 14, 1994

[51] Int. Cl.[6] ..... B65D 91/00

[52] U.S. Cl. ..... 232/43.1; 232/44

[58] Field of Search ..... 446/8.9; 232/1 R, 232/43.1, 43.3, 43.4, 44; 220/210, 730, DIG. 21; 206/366, 370, 457

[56] References Cited

U.S. PATENT DOCUMENTS

| | | | |
|---|---|---|---|
| 1,139,436 | 5/1915 | Netter | 232/43.3 |
| 1,238,010 | 8/1917 | Fisher | 232/43.3 |
| 1,316,023 | 9/1919 | Franklin | 232/43.1 X |
| 2,337,931 | 12/1943 | Rode | 229/8.5 |
| 2,458,234 | 1/1949 | Wilcox et al. | 232/12 |
| 2,726,030 | 12/1955 | Levin | 228/8.5 |
| 4,023,728 | 5/1977 | Gamberg | 232/44 X |
| 4,351,434 | 9/1982 | Elisha | 206/366 |
| 4,679,700 | 7/1987 | Tharrington et al. | 232/1 R X |
| 4,715,498 | 12/1987 | Hanifl | 232/43.1 X |
| 5,027,948 | 7/1991 | Forbes et al. | 232/43.1 X |

*Primary Examiner*—Peter M. Cuomo
*Assistant Examiner*—Jerry Redman
*Attorney, Agent, or Firm*—Wm. Randall May

[57] ABSTRACT

A lightweight, durable, safety accented, collection container is disclosed wherein access to deposited items is restricted and controlled. The primary purpose of the collection container is to prevent and discourage access to potentially harmful items and to allow the user to have access to the collected items only while under the supervision of a responsible adult. The device has an alternating slide system and a trap system which does not allow retrieval of deposited items until a locking mechanism can be engaged and opened by someone with a key or with knowledge of how the locking mechanism operates.

10 Claims, 2 Drawing Sheets

CONTROLLED ACCESS COLLECTION CONTAINER

BACKGROUND OF THE INVENTION

I. Field of the Invention

This invention relates generally to containers for collecting and holding small items and more specifically to a controlled access collection receptacle having various safety features as an integral part of its design.

II. Prior Art and Other Considerations

The celebration of Halloween can be traced to ancient Celtic festivals and has been celebrated throughout modem history in various ways. The Halloween custom of "trick-or-treating", where youngsters go from door-to-door saying the words "trick-or-treat" and collecting treats such as candy, fruit and coins in lieu of playing tricks on their neighbors, became popular in the 1800's. While the custom of "trick-or-treating" continues to be very popular and widely practiced today, the activity has become increasingly dangerous for children, especially in urban areas. More and more accidents involving motorists and trick-or-treating youngsters are, unfortunately, being reported every year as are incidents where children have been given tainted candy treats which have been tampered with so as to make them dangerous and/or potentially deadly. As a result, parents have been urged to take various safety precautions such as dressing their children in light colored costumes or costumes having reflective material, accompanying the child as the child goes from door-to-door, allowing the children to visit only homes or apartments in their own neighborhood, and allowing their children to eat only packaged candy or treats which have been first inspected by an adult. Generally, the children carry a sack or a bucket-type container to collect and hold their treats as they go from house-to-house or door-to-door. A need exists for a protective container which can be brightly and/or reflectively colored and which will allow the child to easily deposit his or her treats into the container but which will not allow the child to access the deposited treats until the treats can be removed and inspected by a parent or other adult.

SUMMARY OF THE INVENTION

In view of the foregoing, it is a primary object of this invention to provide apparatus for a controlled access collection container having specifically designed safety features, for the collection of candy, treats and/or other small collectable items where it is desired that the user have access to the collected items only while under the supervision of a responsible adult.

An advantage of the present invention is the provision of a controlled access collection container which allows candy or other treats to be easily deposited into a holding body but makes the deposited items difficult or impossible to retrieve without adult assistance.

An advantage of the present invention is the provision of a one-way trapping mechanism which allows deposited items to enter a holding body but will not allow the deposited items to exit the device when the holding body becomes inverted or is turned on its side.

Another advantage of the present invention is the provision of a cross-sliding, or screw type, deposit system attached to a holding body which prevents hand access to items deposited into the holding body.

Another advantage of the present invention is the provision of a lockable collection container which limits access and eliminates the temptation for a child to remove deposited items on his own.

A further advantage of the present invention is that use of the device will protect unassuming children from choking, illness or even death by preventing access to candy or treats which may be difficult to swallow, tainted or which may have been tampered with.

Another advantage of the present invention is the provision of a lightweight, controlled access collection container which provides increased visibility to motorists at night and which may be produced in any number of shapes, styles and colors.

A further advantage of the present invention is the provision of a controlled access collection container which gives parents invaluable peace of mind in knowing that their children are protected from ingesting uninspected candy or treats.

According to an embodiment of the invention, a lightweight, controlled access collection container comprises a deposit means, a trap means a containment means and a locking mechanism. The deposit means is comprised of an open top chute means having a gravity feed alternating slide system for allowing deposited items to slide downward, in one direction and then another direction, and to drop through the trap means and into the containment means. The trap means comprises a conventional hinge and coiled spring access door system or a conventional overlapping finger system which will allow the passage of deposited items from only one direction. The containment means comprises a hollow, lightweight receptacle which can be fabricated from various durable materials in any number of shapes, sizes and colors. The locking mechanism is located at the bottom of the containment means and comprises a hinged door having a conventional locking system.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
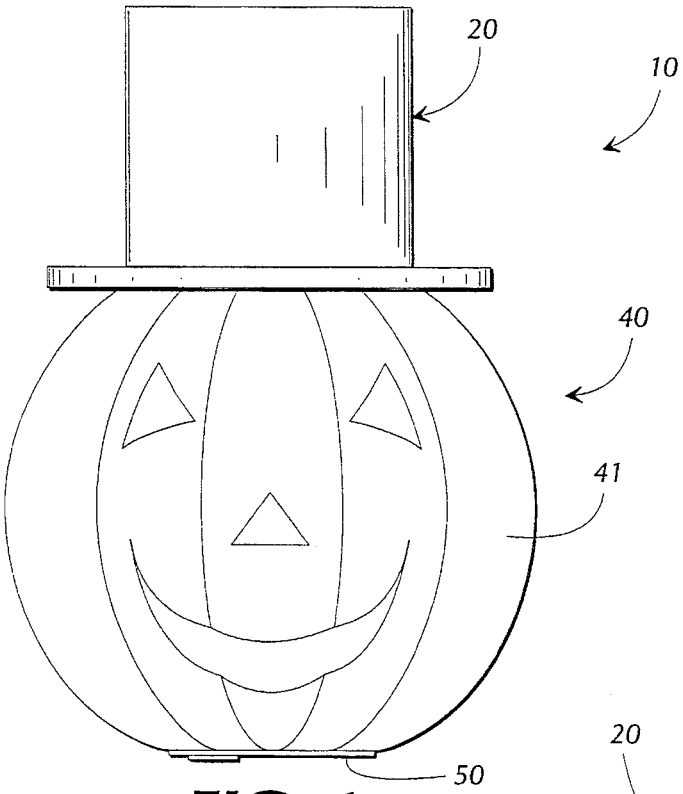
FIG. 1 is a front view of an embodiment of the invention shown using a typical Halloween-oriented design.
Figure 3:
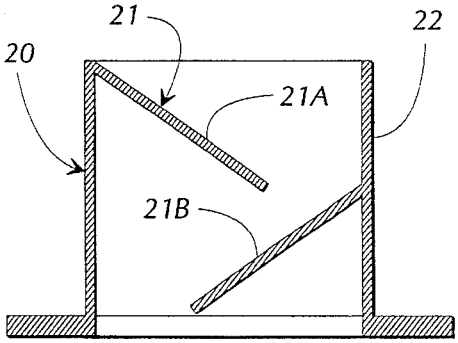
FIG. 3 is a cross-sectional view of the cross slide system of the deposit means of the embodiment of FIG. 1.
Figure 2:
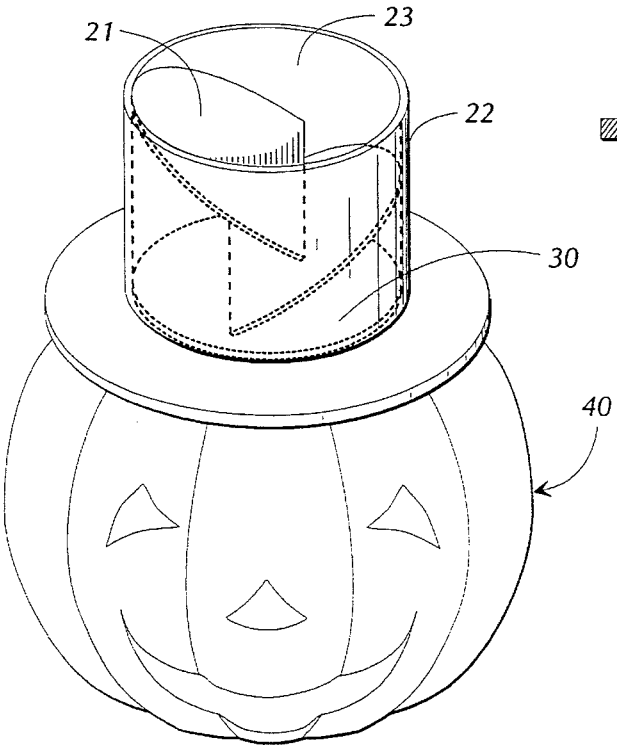
FIG. 2 is a perspective view of the deposit means and trap means of the embodiment of FIG. 1.
Figure 4:
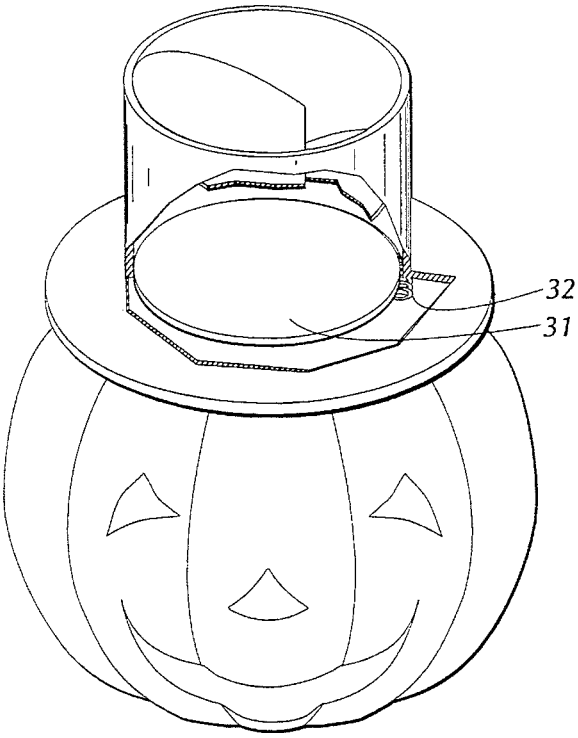
FIG. 4 is a perspective view of the hinged door trap means of embodiment of FIG. 1.
Figure 6:
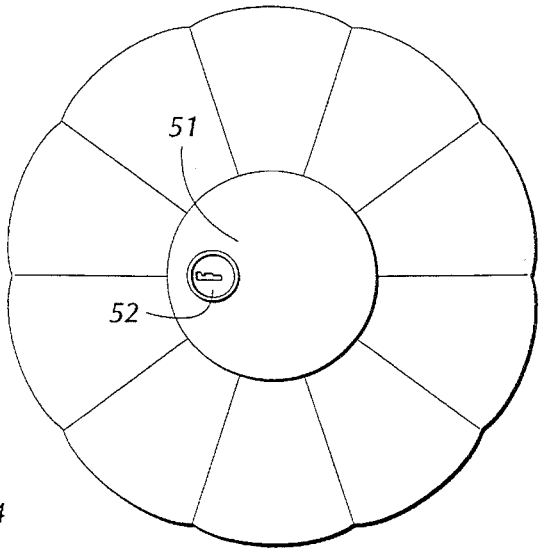
FIG. 6 is a bottom view of the embodiment of FIG. 1 showing the locking mechanism.
Figure 5:
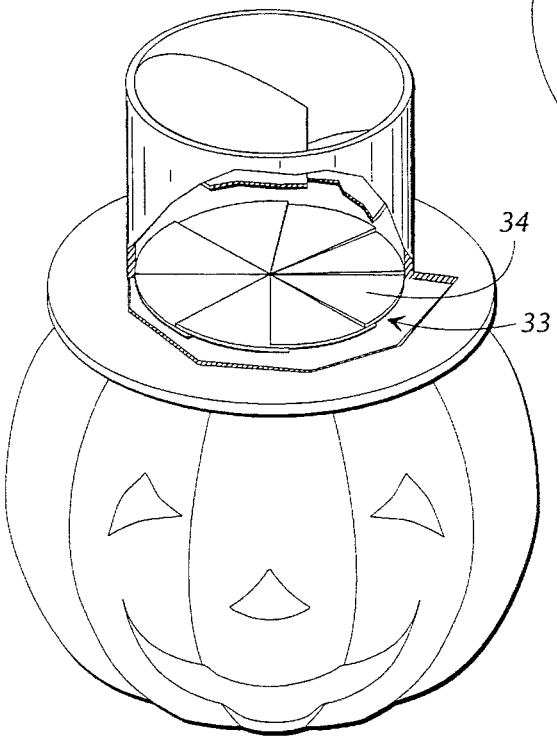
FIG. 5 is a perspective view of the finger system trap means of the embodiment of FIG. 1.

FIGS. 1–6 show a lightweight, durable, controlled access collection container 10 according to an embodiment of the invention. The container 10 comprises a deposit means 20, a trap means 30, a containment means 40 and a locking mechanism 50. The deposit means 20 comprises an open top 23, generally cylindrical, chute means 22 having at least two cross mounted slide panels 21 which are spaced and situated within said chute means 22 so as to allow an item deposited into the opening 23 of the chute means 22 to freely slide, under the force of gravity, down a first slide panel 21A and then, in a different direction, down a second slide panel 21B. The deposited item is then allowed to drop freely through the trap means 30 and into the containment means 40. The deposit means 20 may be in the shape of a hat, as shown in the drawings, or any other design appropriate for the chosen design of the containment means 40. The trap means 30 comprises a conventional hinged trapdoor 31 and coiled spring 32 system which mounts to the base of the chute means 22 and allows deposited items to pass through the trap means 30 in only one direction. The coiled spring 32 attaches to the trapdoor 31 so that the trapdoor 31 remains in a closed position with respect to the chute means 22 until the weight of a deposited item causes the trapdoor 31 to open. The shape of the trap means 30 is commensurate with the horizontal cross-sectional shape of the chute means 30. In an alternate embodiment, the trap means 30 may comprise an overlapping finger system 33, as shown in FIG. 6, whereby overlapping pie-shaped sections 34 allow a deposited item to pass, under its own weight and in only one direction, through the center of said sections 34 and into the containment means 40. The containment means 40 comprises a hollow, lightweight but durable receptacle 41 which may be formed into various decorative or festive Halloween-oriented shapes or figures. The top of the receptacle 41 is open in order to receive deposited items from the deposit means 20. The deposit means 20 is securely and rigidly attached to the top of the containment means 40 as shown. The locking mechanism 50 comprises a conventional hinged door 51 and keylock 52 system and is located at the bottom of the containment means 20. The lock 52 comprises a typical key and latch mechanism or in an alternate embodiment may consist of a typical snap/lever lock mechanism (not shown in the drawings). The collection container 10 may be carried utilizing any conventional handle or strap means.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A lightweight, controlled access collection container comprising:

a deposit means comprising:

a vertical chute means having a top opening and a bottom opening;

and, a slide assembly situated within said chute means;

a trap means attached to said deposit means near the bottom opening of said vertical chute means comprising:

a hinged door; and, a retracting mechanism;

a containment means attached to said deposit means comprising a lightweight, hollow receptacle having a top opening and a bottom opening; and a locking mechanism situated within the bottom opening of said

2. The apparatus of claim 1, wherein said vertical chute means has a decorative external appearance and defines an essentially cylindrical internal surface which is open at either end.

3. The apparatus of claim 1, wherein said slide assembly comprises at least two opposing angle slide panels which are spacably and angularly situated to allow items deposited into the top opening of said chute means to slide under their own weight in alternating downward directions.

4. The apparatus of claim 1, wherein said hinged door of said trap means will open only in a downward direction with respect to said deposit means.

5. The apparatus of claim 1, wherein said retracting mechanism for said trap means comprises a conventional coiled spring which is attached to said hinged door so that the position of said door is normally closed.

6. The apparatus of claim 1, wherein said containment means is fabricated from lightweight, durable, brightly colored materials which can be readily molded into a variety of shapes, forms and sizes.

7. The apparatus of claim 1, wherein said locking mechanism comprises a hinged door having a conventional keyed lock securing means.

8. The apparatus of claim 1, wherein said locking mechanism comprises a hinged door having a conventional friction-fit, snap and lock, latch-type securing means.

9. The apparatus of claim 1, wherein said trap means comprises overlapping and converging, pie-shaped members which are operably situated to allow items to pass freely, under their own weight and in only one direction, through the center of said converging members.

10. A lightweight, durable, controlled access collection container comprising:

a deposit means comprising:

a vertical chute means having a top opening and a bottom opening and opposing angle slide panels which are spacably and angularly situated within said chute means to allow items deposited into the top opening of said chute means to slide, under their own weight, in alternating downward directions;

a trap means attached near the bottom opening of said deposit means comprising:

a hinged door which opens only in a downward direction with respect to the said deposit; and, a retracting mechanism comprising a conventional coiled spring attached to said hinged door for automatic closure of said door;

a containment means attached to said deposit means comprising an open-top, lightweight, hollow receptacle; and, a locking mechanism situated with the bottom opening of said containment means comprising a conventional door and lock assembly.

* * * * *